US009546464B2

(12) United States Patent
Degen et al.

(10) Patent No.: US 9,546,464 B2
(45) Date of Patent: Jan. 17, 2017

(54) VIBRATING ARRANGEMENT FOR PRODUCING COLUMNS OF FILLING MATERIAL

(76) Inventors: Alexander Degen, Munich (DE); Wilhelm Degen, Irvine, CA (US)

( * ) Notice: Subject to any disclaimer, the term of this patent is extended or adjusted under 35 U.S.C. 154(b) by 479 days.

(21) Appl. No.: 13/261,733

(22) PCT Filed: Mar. 9, 2012

(86) PCT No.: PCT/DE2012/200013

§ 371 (c)(1),
(2), (4) Date: Dec. 22, 2014

(87) PCT Pub. No.: WO2012/119601

PCT Pub. Date: Sep. 13, 2012

(65) Prior Publication Data

US 2015/0104260 A1 Apr. 16, 2015

(30) Foreign Application Priority Data

Mar. 9, 2011 (DE) ..... 10 2011 005 267

(51) Int. Cl.
*E02D 3/046* (2006.01)
*E02D 3/08* (2006.01)

(52) U.S. Cl.
CPC ..... *E02D 3/08* (2013.01); *E02D 3/046* (2013.01)

(58) Field of Classification Search
CPC ..... E02D 3/046; E02D 3/08
See application file for complete search history.

(56) References Cited

U.S. PATENT DOCUMENTS 3,303,656 A * 2/1967 Landau ..... E02D 3/106 405/241
3,772,894 A * 11/1973 Godley ..... E02D 3/106 405/50
4,158,518 A * 6/1979 Rusche ..... E02D 5/36 405/233
4,269,544 A * 5/1981 Rusche ..... E02D 15/04 405/233
4,384,809 A * 5/1983 Rusche ..... E02D 15/04 405/240
5,141,364 A * 8/1992 Degen ..... E02D 5/18 405/233
5,152,639 A * 10/1992 Visconti ..... E02D 5/385 405/233

(Continued)

FOREIGN PATENT DOCUMENTS

EP 0 861 944 A1 9/1998
EP 2 103 742 A1 9/2009

(Continued)

*Primary Examiner* — Benjamin Fiorello
(74) *Attorney, Agent, or Firm* — Muirhead and Saturnelli, LLC

(57) ABSTRACT

A vibrating arrangement includes at least one elongate silo tube for receiving filling material, the silo tube having a longitudinal direction, a lengthwise filling material outlet at one end of the silo tube and a casing. At least one vibrator is disposed on the silo tube. At least one outer closure is disposed on the casing of the silo tube. At least one filling material container is disposed so as to be movable along the longitudinal axis of the silo tube before the outer closures, in which the filling material container has at least one opening facing the casing of the silo tube.

23 Claims, 6 Drawing Sheets

(56) References Cited

U.S. PATENT DOCUMENTS

| | | | | | |
|---|---|---|---|---|---|
| 5,256,003 | A | * | 10/1993 | Ito | E02D 3/106 405/232 |
| 5,304,016 | A | * | 4/1994 | Kunito | E02D 5/46 405/233 |
| 5,647,690 | A | * | 7/1997 | Landau | E02D 3/106 405/233 |
| 5,980,161 | A | | 11/1999 | Degen et al. | |

FOREIGN PATENT DOCUMENTS

| | | | |
|---|---|---|---|
| WO | WO 03/091503 | A1 | 11/2003 |
| WO | WO 2009/115579 | A1 | 9/2009 |

* cited by examiner

VIBRATING ARRANGEMENT FOR PRODUCING COLUMNS OF FILLING MATERIAL

TECHNICAL FIELD

This application relates to a vibrating arrangement for producing columns of filling material.

BACKGROUND OF THE INVENTION

Vibrating arrangements for producing columns of material or filling material in the earth are generally known. The columns of material consist, for example, of sand or gravel, the grain or grit size of which can be coordinated in each case with the use location. Vibrating arrangements of this type comprise at least one silo tube or material tube with a filling material outlet at one end, and a vibrator arranged on the silo tube. In the case of vibrating arrangements which are designed as depth vibrators, the vibrator is arranged at a lower end of the silo tube and is located in the ground during operation, and, in the case of top vibrators, the vibrator is arranged at the top of the material tube.

Known vibrating arrangements have a filling material container which is arranged in the upper region of the silo tube and which serves to supply filling material to the silo tube. In this case, the filling material container has to be filled at some height above the ground using a suitable construction machine, which may constitute a considerable outlay.

WO 90/15904 proposes a method for producing columns of filling material, in which a silo tube is filled with filling material at ground level. For this purpose, the silo tube is provided with openings through which the filling material is intended to flow into the silo tube. The openings are not closable, and therefore earth can penetrate the silo tube when the silo tube is located within the cavity.

Accordingly, it would be desirable to provide a vibrating arrangement which does not have the abovementioned disadvantages.

SUMMARY OF THE INVENTION

According to the system described herein, a vibrating arrangement comprises, according to one exemplary embodiment: at least one elongate silo tube for receiving filling material, said silo tube having a longitudinal direction, a filling material outlet at one longitudinal-side end of the silo tube and a casing; at least one vibrator which is arranged on the silo tube; and at least two outer closures which are arranged on the casing of the silo tube and are arranged spaced apart from one another along the longitudinal direction of the silo tube.

The vibrating arrangement can have a plurality of silo tubes which are arranged next to one another transversely with respect to the longitudinal direction.

Furthermore, the vibrating arrangement can have at least one inner closure in the interior of the silo tube, said inner closure being arranged in the longitudinal direction between two outer closures. A further inner closure can be arranged in the silo tube between two further outer closures. Any number of inner closures can be arranged in the interior of the silo tube and any number of outer closures can be arranged on the casing of the silo tube.

The vibrator of the vibrating arrangement can be designed as a depth vibrator or as a top vibrator.

The vibrating arrangement can have a filling material container which is movable in front of the outer closures. The filling material container can be arranged movably along at least one guide rail arranged on the silo tube. The filling material container can be guided on the guide rail, for example, by means of rollers. For this purpose, guide rails can be arranged on the silo tube.

According to a further exemplary embodiment, the vibrating arrangement according to the system described herein comprises: at least one elongate silo tube for receiving filling material, said silo tube having a longitudinal direction, a filling material outlet at one longitudinal-side end of the silo tube and a casing; at least one vibrator which is arranged on the silo tube; at least one outer closure arranged on the casing of the silo tube; and at least one filling material container arranged movably along the longitudinal axis of the silo tube in front of the outer closures, wherein the filling material container has at least one opening which faces the casing of the silo tube.

Exemplary embodiments of the system described herein afford in particular the advantage that the silo tubes do not have to be filled with filling material at the upper end of said tubes at a considerable height from the ground. The movable filling container for providing the filling material can be arranged, for example, in a stationary manner on the ground resting on the soil and can be filled there. The silo tube can then be moved past the stationary filling container and can be filled with filling material via the outer closures. As a result, the space requirement upward is considerably reduced compared to conventional vibrating arrangements. This may be advantageous or even necessary at some use locations. Examples of such use locations are approach paths at airports, i.e. locations at which an operation can be carried out only at a low height for safety reasons. In addition, the vibrating arrangement is mechanically considerably relieved of load if the filling material container is arranged resting on the ground, since the vibrating arrangement itself no longer has to support the filling container.

BRIEF DESCRIPTION OF THE DRAWINGS

Exemplary embodiments are explained in more detail below with reference to figures. The figures serve to illustrate the basic principle of the system described herein, and therefore only the aspects necessary for understanding this basic principle are illustrated. The figures are not necessarily true to scale. The same reference numbers denote identical or equivalent parts having an identical or equivalent meaning.

DETAILED DESCRIPTION OF VARIOUS EMBODIMENTS

Vibrating arrangements with a vibrator and a silo tube are used for solidifying and for compacting earth (ground improvement). By means of the vibrator, the vibrating arrangements generate vibrations which compact the earth and thereby penetrate into the earth. As a result, an approximately cylindrical and elongate cavity is produced in the earth. In order to produce a column of filling material, filling material, which can be, for example, gravel or sand, can be introduced into the cavity via the silo tube. The vibrating arrangement for compacting the filling material is then moved downward again, and therefore the filling material is pressed both in the direction of the base of the cavity and in the direction of the cavity walls. The vibrating arrangement is subsequently moved upward and once again places filling material into the cavity and compacts said filling material using the vibrating arrangement 1. This is repeated until the cavity is filled with filling material completely or at least to a desired height (in accordance with the respective requirements) and ultimately a column of filling material has been produced in the earth. A multiplicity of such columns of filling material are generally produced over a defined area in order to improve the ground in this area. Examples of the effects of such methods include increased load-bearing capacity of the ground, a reduction in the inclination of liquefaction of the ground and a reduction in ground subsidence after construction.

Figure 1:
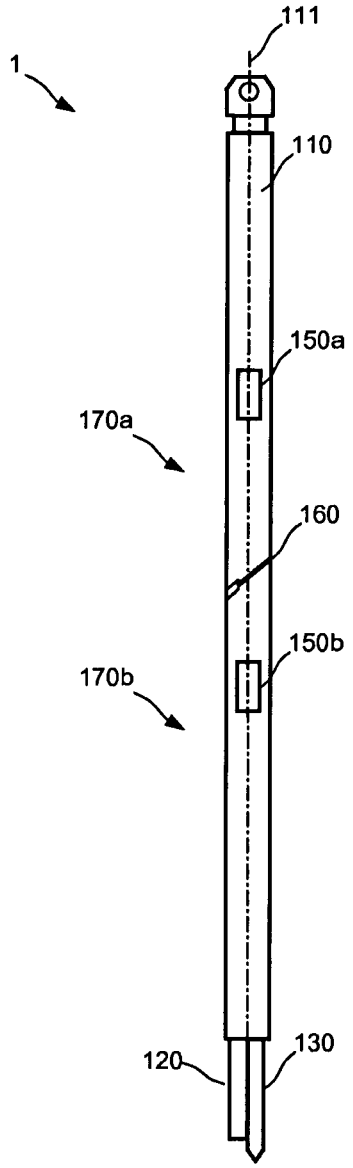
FIG. 1 illustrates an exemplary embodiment of a vibrating arrangement with a depth vibrator, two outer closures, a silo tube and an inner closure.

FIG. 1 illustrates an exemplary embodiment of a vibrating arrangement 1 for carrying out a method of this type. The vibrating arrangement 1 has a silo tube 110 which is elongate in a longitudinal direction 111 and can be filled with gravel or sand or another suitable filling material. The silo tube 110 has a filling material outlet 120 at a lower end of the vibrating arrangement 1. The vibrating arrangement 1 furthermore has a vibrator 130. In the exemplary embodiment shown in FIG. 1, the vibrator 130 is designed as a depth vibrator and is arranged in the longitudinal direction next to the filling material outlet 120 at the lower end of the vibrating arrangement 1, which end faces the earth or the ground. During the operation, the vibrator 130 generates vibrations which enable the vibrating arrangement to penetrate the ground or the soil. Depth vibrators, such as the depth vibrator 130 illustrated in FIG. 1, are basically known, and therefore further explanations in this regard can be omitted. It should be pointed out that the use of a depth vibrator should merely be regarded as an example. It is also possible, of course, for use to be made of any other vibrators, such as, for example, top vibrators (not illustrated), which can then be arranged at the upper end of the silo tube 110 or of the vibrating arrangement 1, which end faces away from the ground or the soil.

The silo tube 110 can have any cross section in a sectional plane perpendicular to the longitudinal direction 111, such as, for example, an elliptical, in particular circular, cross section, a rectangular cross section or any polygonal cross section. The outer covering or the casing surface or covering surface of the silo tube is referred to below as the casing. The length of the silo tube 110 lies, for example, within the range between 5 m and 20 m, and the cross-sectional area of the silo tube 110 lies, for example, within the range of between 0.03 $m^2$ and 0.25 $m^2$, with the diameter or the length of the main axis being between 0.2 m and 0.5 m in the case of a circular or elliptical silo tube.

The vibrating arrangement 1 has at least one outer closure 150*a*, 150*b* on the casing of the silo tube 110. In the exemplary embodiment shown in FIG. 1, two outer closures 150*a*, 150*b* are arranged spaced apart from each other in the longitudinal direction 111. It is also possible for more than two outer closures or for merely one outer closure to be provided. The at least one outer closure 150*a*, 150*b* is designed in such a manner that it can open and close a corresponding opening on the silo tube 110. The outer closure 150*a*, 150*b* can be designed in particular in such a manner that it closes off the interior of the silo tube 110 from the external environment in an air-tight manner.

Furthermore, the vibrating arrangement 1 can have at least one inner closure 160 which is arranged in the interior of the silo tube 110. Said inner closure 160 is designed in such a manner that it can divide the silo tube 110 in the interior such that filling material located in the silo tube can optionally pass or not pass the inner closure 160. The inner closure 160 can also be designed in such a manner that it separates the two sections of the silo tube, between which it is arranged, from each other in an air-tight manner. The inner closure 160 is designed in particular in such a manner that it is arranged completely within the silo tube, and therefore parts of the inner closure 160 do not protrude beyond the casing 110 either in the open or in the closed state of the closure 160 and therefore the inner closure 160 does not obstruct the silo tube 110 from penetrating the ground.

According to one exemplary embodiment, the vibrating arrangement has only one outer closure; such as, for example, the outer closure 150*a* according to FIG. 1, and an inner closure 160. The inner closure 160 is arranged here in the longitudinal direction below the outer closure 150*a* and forms a lock with the outer closure 150*a*. In the example illustrated, said outer closure is arranged at a distance from an upper end of the silo tube. However, this is merely an example. According to a further example, the one outer closure is arranged adjacent to the upper end in the casing 110. According to a further example, the one outer closure is arranged on the end side at the upper end of the silo tube. Of course, even when there are a plurality of outer closures, there is the possibility of arranging one of the closures on the casing of the silo tube 110 directly at the upper end or even of arranging said closure on the end side at the upper end.

Figure 2:
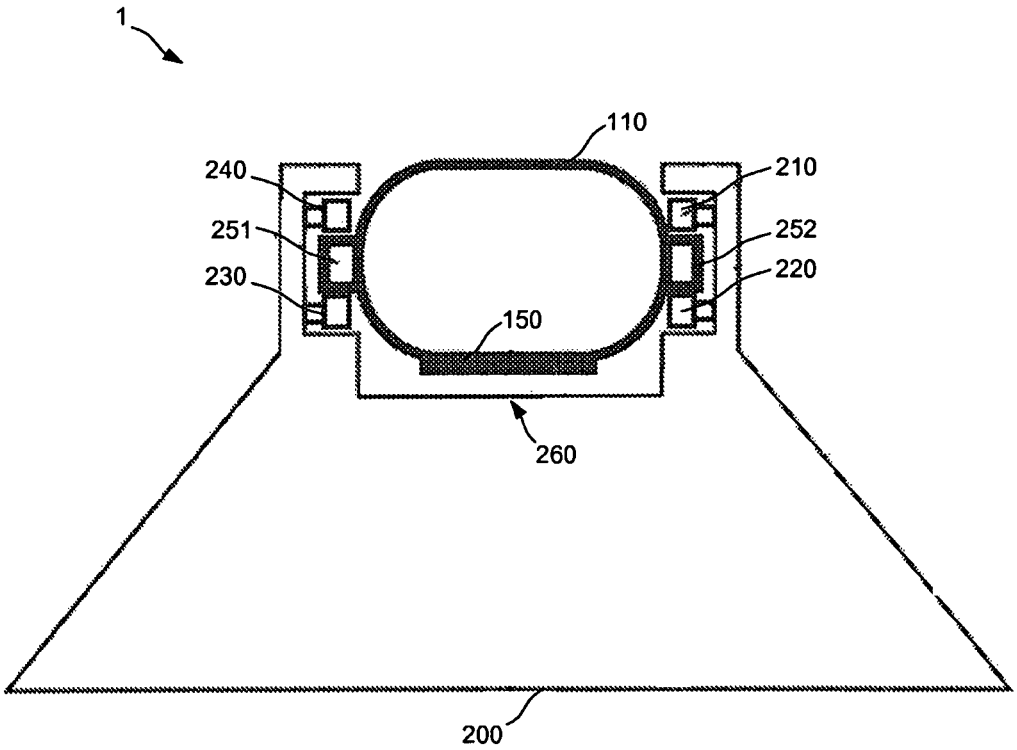
FIG. 2 illustrates, in a sectional illustration, an exemplary embodiment with a silo tube and a filling material container guided along the silo tube.

In order to fill the silo tube 110 with filling material, a filling material container 200, which is movable in the longitudinal direction along the silo tube 110, can be provided. FIG. 2 shows a horizontal cross section, i.e. a cross section in a sectional plane perpendicular to the longitudinal direction of the silo tube 110, through the filling material container 200 and through the silo tube 110.

Two guide rails 251, 252 can be arranged on the silo tube 110 on the opposite casing sides thereof in each case. The filling material container 200 can be arranged movably along the longitudinal direction 111 on said guide rails 251, 252 in front of the at least one outer closure 150*a*, 150*b*. Instead of two guide rails 251, 252, it is alternatively possible also to provide just one guide rail or more than two guide rails can be provided (not illustrated in FIG. 2). The filling material container 200 has at least one opening 260 which faces the casing, in particular the at least one outer closure of the silo tube. Said opening 260 can correspond here to the outer closures 150*a*, 150*b*, but it may also be smaller or larger than the outer closures. In order to guide the filling container 200, which is arranged movably on the vibrating arrangement 1, rollers 210, 220, 230, 240, 250 can be provided. It is possible, as shown in FIG. 2, for in each case two rollers 210, 220 and 230, 240 to act non-positively on a respective guide rail 252 and 251 such that only one degree of freedom along the longitudinal direction 111 of the vibrating arrangement 1 remains for the movability of the filling container 200. It is furthermore also possible to arrange more than one filling container 200, for example two filling material containers, spaced apart from one another along the longitudinal direction on the vibrating arrangement. The filling material container can be fixed at any position of the silo tube, such as, for example, in front of one of the outer closures, in order then to deliver material via the respective outer closure each time that said outer closure is opened.

It should be pointed out that the provision of a filling container which is movable on the silo tube 110, as illustrated in FIG. 2, is not limited to being provided on a silo tube, such as the silo tube 110 according to FIG. 1, with at least two outer closures which are spaced apart in the longitudinal direction, such as the outer closures 150*a*, 150*b* according to FIG. 1. Such a movable filling container can be provided on any silo tube of a vibrating arrangement, such as, for example, on a silo tube which merely has one supply opening on the casing of the silo tube or at an upper end-side end. Depending on whether the supply opening is located at a position which, during operation of the vibrator, penetrates the ground, the supply opening is or is not closable by an outer closure—comparable to one of the closures 150*a*, 150*b* according to FIG. 1. A lock for filling material can be provided in the interior of the silo tube, wherein the one supply opening is arranged on the silo tube above the lock.

According to a further exemplary embodiment (not illustrated), the silo tube is filled by a supply line or a supply hose, which is designed in order to convey filling material, via one of the outer closures. One end of said conveying hose, which end faces the silo tube 110 and is also referred to below as the outlet end, is fastened, for example, to a slide which is movable along the silo tube. As a result, the outlet end can be moved to and fro between different outer closures if a plurality of outer closures are present, and the outlet end can be held on the silo tube above the ground when the silo tube moves into the ground. A material conveying device, such as, for example, a pump, which supplies material to the supply hose, can be arranged at an end of the supply hose opposite the outlet end.

FIGS. 1 and 2 illustrate essential components of exemplary embodiments of a vibrating arrangement 1 according to the invention. Possible functional principles of the vibrating arrangement shown are explained below with reference to the exemplary embodiments shown in FIGS. 1 and 2.

In the case of the exemplary embodiments illustrated in FIG. 1, two outer closures 150*a*, 150*b* are arranged on the casing of the silo tube 110, namely a first outer closure 150*a* and a second outer closure 150*b*, which is arranged in the direction of the lower end at a distance from the first outer closure 150*a*. A distance between said two outer closures 150*a*, 150*b* is, for example, between 1 m and 5 m. An inner closure 160 is provided in the interior of the silo tube 110 between the two outer closures 150*a*, 150*b*. In addition, it is possible to provide a further inner closure (not illustrated) which is arranged in the direction of the lower end of the silo tube 110 below the second outer closure 150*b*. An inner closure 160 divides the silo tube into two chambers, and a plurality of inner closures divide the silo tube into, correspondingly, a plurality of chambers. The outer closures 150*a*, 150*b* can produce air-tight or pressure-tight seals. During the operation, a positive pressure atmosphere in relation to the environment, in particular the environment in the cavity produced, can therefore be built up in the silo tube 110. This may be necessary particularly at relatively great cavity depths in order to avoid the penetration there of water or liquefied soil into the silo tube since this could have an adverse effect, for example, on the flow capability of the filling material. Said outer closures 150*a*, 150*b* here are in each case realized "in such an air-tight manner" that, when the closure 150*a*, 150*b* or 160 is closed, the positive pressure present in the silo tube 110 cannot escape via the respective closure.

Correspondingly, the at least one inner closure 160 can produce an air-tight or pressure-tight seal. This prevents a positive pressure in a chamber when the inner closure 160 is closed from being able to escape into an adjacent, different chamber separated from the first chamber by the inner closure.

If a column filling material is then to be produced in the earth, a cavity is formed in the earth by vibrating, for example with the inner closure 160 initially closed. The filling material container 200 can be arranged, for example, in a stationary manner resting on the ground and can be filled continuously with filling material. In addition, there is also the possibility of arranging the filling material container 200 movably on the silo tube 110. If the vibrating arrangement 1 carries out vibrating movements, it penetrates the ground and moves downward along the longitudinal direction 111 relative to the filling material container 200 into the ground. If one of the outer closures 150, such as, for example, first of all the second outer closure 150*b*, reaches the opening 260 in the filling material container 200, the corresponding outer closure 150*b* can be opened. The filling material container 200 and the opening 260 therein are designed here in such a manner that filling material can be introduced into the silo tube 110 through the opening 260 via the opened outer closure 150*b*.

If the vibrating arrangement penetrates further into the soil, the second outer closure 150*a* also reaches the opening 260 in the filling material container. When the inner closure 160 is closed, the upper silo tube region 170*a* can be filled with filling material. If this filling operation is ended, the outer closure 150*a* is closed (in an air-tight manner). A positive pressure can then be generated in the lower region 170*b* in order to prevent ground water or moisture from penetrating the silo tube. A lock-like effect is achieved here with the inner closure 160, specifically in such a manner that positive pressure has to be produced only in the region 170*b*, but not over the entire silo tube 170*a*, 170*b*, which requires, for example, less powerful compressors.

If the vibrating arrangement 1 has then produced a cavity of a desired depth, said vibrating arrangement is moved upward out of the cavity, as a result of which the filling material located in the region 170*b* is introduced into the cavity, since the filling material outlet 120 is no longer blocked by earth. Owing to the positive pressure atmosphere prevailing in the region 170*b* and in the filling material outlet 120, only little water or liquefied soil, if any at all, can penetrate into the filling material outlet and the region 170*b* of the silo tube. If a desired quantity of filling material has been placed into the cavity, the vibrating arrangement is guided again into the cavity in order to solidify the filling material which is already in the cavity and which is pressed in the process firstly in the direction of the cavity base and in the direction of the cavity walls. The vibrating arrangement is subsequently moved upward again, as a result of which filling material is placed again into the cavity via the filling material outlet 120. The newly introduced filling material is then compacted and solidified again. It should be noted in this connection that the silo tube can be open downward, i.e. in the direction of the filling material outlet, such that each time that the vibrating arrangement is moved upward, filling material "automatically" flows out of the silo tube 110 into a cavity formed below the silo tube.

If no more water or liquefied soil can penetrate into the silo tube, for example if the filling height of the column of filling material is already above the ground water level, a positive pressure atmosphere within the silo tube 110 is no longer necessary. The inner closure 160 can be opened, since the lock effect thereof is no longer required. After opening of the inner closure 160, the filling material located in the region 170*a* can penetrate into the region 170*b* and on into the cavity, wherein said filling material is first of all introduced in a certain amount into the cavity and is subsequently compacted.

Filling material is then admitted again into the cavity. This is repeated until a defined height of the column of filling material is reached, wherein filling material can always be supplied in each case to the silo tube whenever the outer closures 150*a*, 150*b* pass the opening 260 of the filling material container 200. The admission of filling material can be regulated using the lock formed by the inner closure 160 since the receiving capacity of a silo tube region 170*a*, 170*b* is known in advance. The receiving capacity is, for example, 1 $m^3$ in the region 170*a*. From a certain filling height, only the lower outer closure 150*b* can still be used.

If the column of filling material reaches a height at which the outer closure 150*b* can no longer pass to the opening 260 of the filling material container 200, which is located in a stationary manner on the ground, the filling material container can be fastened to the silo tube 110 in such a manner that the opening 260 and the outer closure 150*b* always lie opposite each other. The filling material container 200 is then moved upward together with the silo tube 110 until the column of filling material has reached the desired filling height. For this purpose, the filling material container 200 has to be filled in a suitable manner above ground level (for example using a suitable construction machine or a suitable conveying device).

Alternatively, the cavity can first of all be produced without filling material being supplied to the silo tube 110. If the cavity has reached the desired depth, the vibrating arrangement is moved upward. In the process, the outer and inner closures 150*a*, 150*b*, 160 can be actuated in such a manner that the filling material can be placed, as described above, into the cavity.

Figure 3:
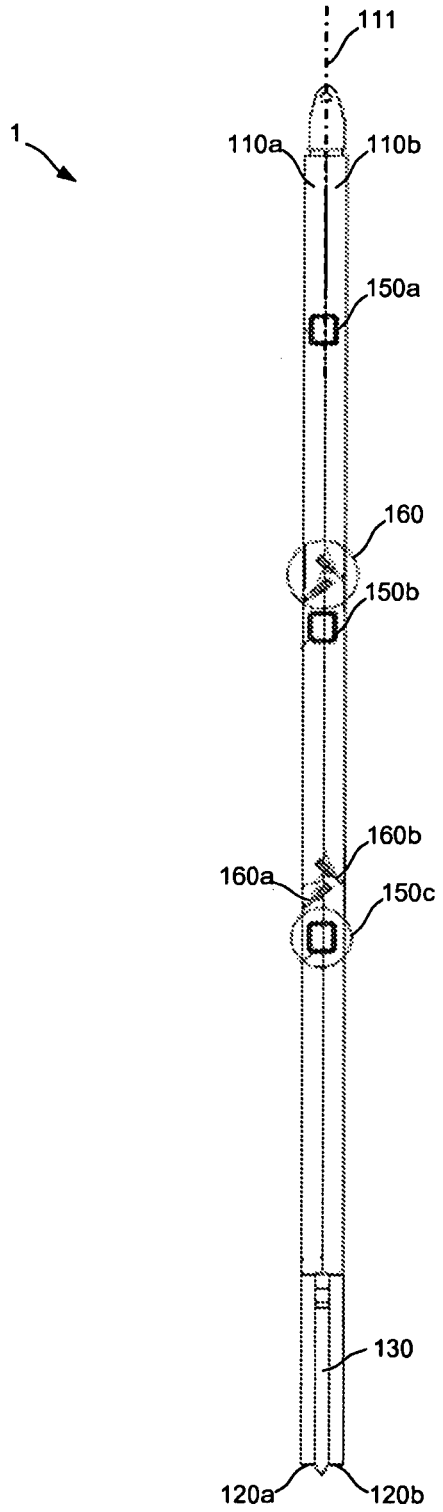
FIG. 3 illustrates an exemplary embodiment of a vibrating arrangement with a depth vibrator, a plurality of outer closures and two silo tubes.

The vibrating arrangement 1 shown in FIG. 3 has two silo tubes 110*a*, 110*b* which are elongate in a longitudinal direction 111 and are arranged next to each other transversely with respect to the longitudinal direction 111. It should be mentioned at this juncture that basically any number of silo tubes can be arranged in a vibrating arrangement. The two silo tubes 110*a*, 110*b* can be filled with filling material. At a lower end of the vibrating arrangement, each silo tube 110*a*, 110*b* has a filling material outlet 120*a*, 120*b*, wherein, in the case of two silo tubes 110*a*, 110*b*, a common filling material outlet 120 can also be provided. In the exemplary embodiment shown in FIG. 3, a vibrator 130 is arranged between the two filling material outlets 120*a*, 120*b*. This vibrator is a depth vibrator which is attached to the lower end of the vibrating arrangement, i.e. on the ground side. In this exemplary embodiment too, the vibrator 130 also generates vibrations which allow the vibrating arrangement 1 to penetrate the soil or the ground.

The vibrating arrangement 1 shown in FIG. 3 can be designed in such a manner that at least one or each of the outer closures 150*a*, 150*b*, 150*c* is common to the two silo tubes 110*a*, 110*b* such that a closure opens or closes corresponding openings on the casings of the two silo tubes 110*a*, 110*b* simultaneously. An outer closure of this type can accordingly extend over the two silo tubes 110*a*, 110*b* transversely with respect to the longitudinal direction 111.

The vibrating arrangement 1 according to FIG. 3 furthermore has at least one inner closure or a plurality of inner closures 160 which are arranged in the interior of the silo tube 110*a*, 110*b*. Said inner closures 160 can be produced in such a manner that they entirely or partially close the corresponding silo tube 110*a*, 110*b* on the inside such that filling material located in the silo tube 110*a*, 110*b* cannot penetrate through the inner closure 160. The inner closures 160 can also be designed here so as to produce an air-tight seal in the interior of the respective silo tube 110*a*, 110*b*. According to the exemplary embodiment shown in FIG. 3, at least one such inner closure 160 is arranged between two outer closures 150*a*, 150*b*. It is furthermore shown in FIG. 2 that a further inner closure 160 can be arranged between two further outer closures 150*b*, 150*c*. Two inner closures 160 which are arranged spaced apart in the longitudinal direction 111 can form an air and/or filling material lock when they are appropriately activated.

Figure 4:
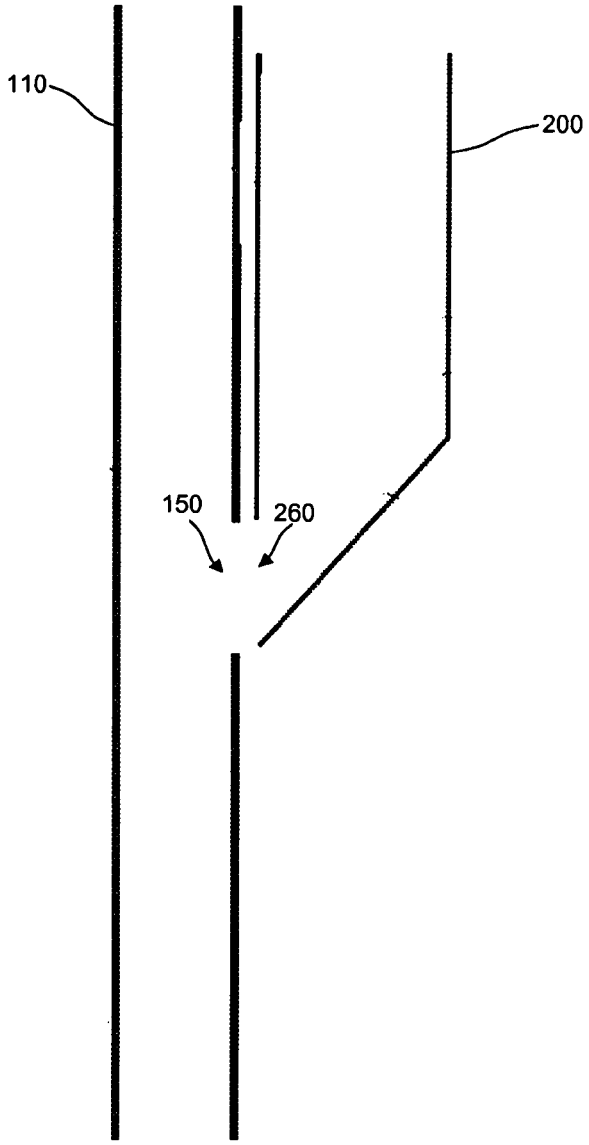
FIG. 4 illustrates, in a side view, a sectional illustration of an exemplary embodiment with a silo tube, outer closures and with a filling material container.

FIG. 4 shows a sectional illustration of an exemplary embodiment with a silo tube 110, an outer closure 150 and with a filling material container 200, in a side view. The filling material container 200 here can be shaped in such a manner that the filling material easily flows to the opening 260. The opening 260 can be designed to be closable. Furthermore, the filling material container 200 can be provided with a further opening (not shown) for supplying the filling material. It is also possible to provide, instead of the filling material container 200, a suitable conveying device for supplying the filling material.

Figure 5A:
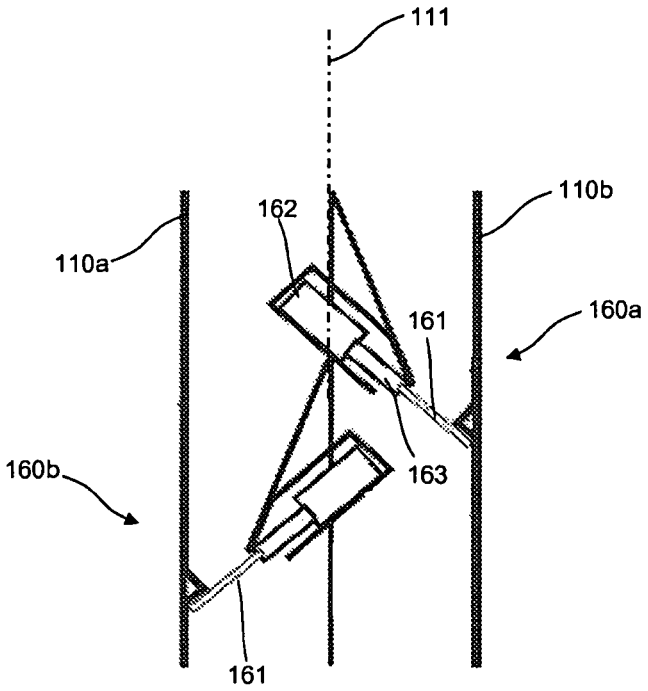
FIG. 5 illustrates, in a first sectional illustration (FIG. 5A), an exemplary embodiment with two silo tubes each having an inner closure and, in cross section in a second sectional illustration (FIG. 5B), two silo tubes arranged next to each other.

FIG. 5A shows by way of example how two of the inner closures 160*a*, 160*b* can be arranged in two silo tubes 110*a*, 110*b* arranged next to each other transversely with respect to the longitudinal direction 111. Said inner closures 160*a*, 160*b* each have a movable closure plate 161 which can be moved into a receptacle 163 via a drive unit 162 such that the filling material in the corresponding silo tube 110*a*, 110*b* can pass the inner closure 160*a*, 160*b*. The inner closures 160*a*, 160*b* can be designed in such a manner that the silo tubes can in each case be closed in an air-tight manner there so that positive pressure atmospheres can be generated in the silo tube regions 170*a*, 170*b*. In the example illustrated, the closure plates 161 are arranged obliquely with respect to the longitudinal direction of the silo tubes 110*a*, 110*b* and are movable obliquely in relation to said longitudinal direction. An angle between the plates 161 and the longitudinal direction is, for example, between 45° and 60°.

Figure 5B:
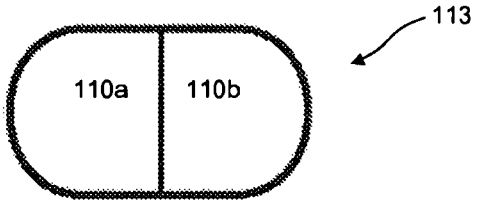

The drive unit 162 shown in FIG. 5A can be activated manually or automatically. The drive unit 162 can be designed in particular as a pneumatic drive, an electric drive or as any other suitable drive. FIG. 5B shows a cross section 113 through the two silo tubes 110*a*, 110*b*, which are arranged next to each other, of the exemplary embodiment. The silo tubes 110*a*, 110*b* have flat surfaces on the mutually facing surfaces such that the silo tubes 110*a*, 110*b* can be arranged next to each other as far as possible without joints and intermediate spaces. The silo tubes 110*a*, 110*b* can be of rounded design on the sides facing away from the other silo tube in each case. Two silo tubes 110*a*, 110*b* can also be formed from a correspondingly shaped silo tube, into which a partition is fitted.

In the exemplary embodiment illustrated in FIG. 5A, the inner closures are arranged in such a manner that the drive—a hydraulic cylinder in the example—of an inner closure 160*a*, 160*b* in a silo tube 110*a*, 110*b* projects into the other silo tube 110*b*, 110*a* in each case. This permits a particularly space-saving realization of the inner closures.

If only one silo tube is present, as in the case of the exemplary embodiment according to FIG. 1, the inner closure 160 can be realized in the form of an inner closure of one of the silo tubes, but with the difference that the inner closure 160 of a single tube does not project beyond the single silo tube 110.

Figure 6:
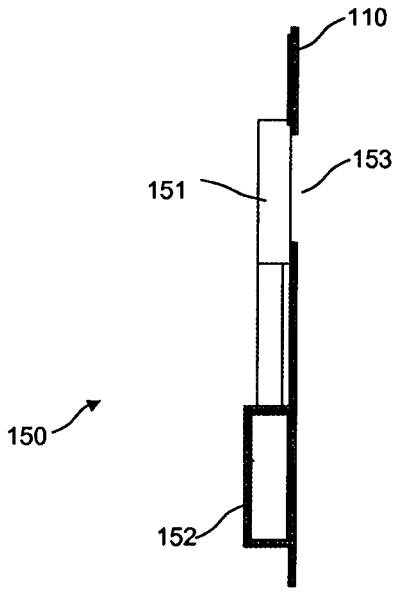
FIG. 6 illustrates, by way of example, an outer closure with a closure plate and drive unit, in a side view.

FIG. 6 illustrates, in a side view, an outer closure 150, by way of example, which is arranged on the casing of a silo tube 110 and which can be used in the previously explained vibrating arrangements. In the exemplary embodiment shown, the closure 150 has a closure plate 151 and a drive unit 152. The closure 150 can be designed to seal the interior of the silo tube 110 from the environment in an air-tight manner. Furthermore, arbitrary further closures which are suitable for sealing the interior of the silo tube 110 from the environment in an air-tight manner are conceivable. The outer closure can be opened and closed when required by means of a control unit (not illustrated) which actuates the drive unit 152. The outer closure is opened in the previously explained manner, for example in each case whenever filling material is intended to be supplied. The drive unit 151 is, for example, an electric drive unit and/or a hydraulic drive unit.

In the exemplary embodiment according to FIG. 6, a closure plate 151 is mounted displaceably in such a manner that the closure plate 151 can be moved parallel to the casing of the silo tube by the drive unit 152 in order to open up or close an opening 153 in the casing of the silo tube.

Figure 7:
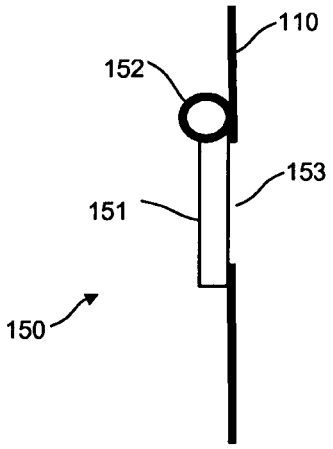
FIG. 7 illustrates a further example of an outer closure.

In a further exemplary embodiment which is illustrated in FIG. 7, the closure plate 151 is mounted rotatably or tiltably in relation to the casing of the silo tube. The closure plate 151—as also in the example according to FIG. 6—is larger than the opening 153 in order to be able to completely close the opening 153. The drive unit 152 is designed to tilt the closure plate 151 inward away from the opening 153 in order to open up the opening for the supply of material, or to press the closure plate 151 against the casing of the silo tube 110 in order to close the opening 153.

In a further exemplary embodiment, the drive unit 152 according to FIG. 7 is designed in order to press the closure plate 151 only against the casing of the silo tube 110 and in order to open up the opening 153 when a force is exerted on the closure plate 151 from the outside, said force pressing the closure plate 151 inward. In this case, control of the closure plate via the drive unit 152 can be dispensed with. Opening always takes place whenever a force is exerted on the closure plate 151 from the outside, said force opening the closure plate 151, wherein the drive unit 152 presses the closure plate 151 again against the casing in order to close the opening 153 or the closure 150 when the external force ceases. For this purpose, the drive unit comprises, for example, a spring mechanism which is realized in such a manner that the closure plate 151 is opened counter to a spring force, or a hydraulic mechanism with a bubble store, which is realized in such a manner that the closure plate 151 is opened counter to a hydraulic force.

The external force for the opening can take place, for example, though the supply container 200. The supply container can have, for example, a lug which presses against the closure plate in order to open the latter when the container is located in front of the opening 153.

An inner closure 160 which has been explained in conjunction with FIG. 1 and which is arranged completely within the silo tube 110, or inner closures 160*a*, 160*b*, which have been explained in conjunction with FIG. 5A and which are completely arranged within a tube arrangement having two or more silo tubes, are not limited to being used in conjunction with outer closures. The previously explained arrangements can thus be modified, for example, in such a manner that the outer closures are omitted and that, instead, material is supplied from above, i.e. via an upper end-side end of the silo tube. In order to meet height limitations, material can be supplied, for example, via a supply line, and therefore a voluminous material container above the silo tube 110 can be dispensed with. Two or more inner closures can be provided in the interior of a silo tube, wherein in each case two adjacent inner closures form a lock.

Finally, it is emphasized that elements and components which have been previously explained in conjunction with a certain exemplary embodiment can also be combined with elements and components from other exemplary embodiments even if this has not been explicitly explained in the above text, and without departing from the inventive concept.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A vibrating arrangement, comprising:

at least one silo tube for receiving filling material, the at least one silo tube having a longitudinal direction, a filling material outlet at one end of the at least one silo tube, and a casing;

at least one vibrator arranged on the at least one silo tube; and at least one outer closure arranged on the casing of the at least one silo tube, wherein the at least one outer closure is closable in an air tight manner, wherein the vibrating arrangement comprises at least two outer closures, wherein the at least two outer closures are arranged spaced apart from one another along the longitudinal direction.

2. The vibrating arrangement as claimed in claim 1, wherein the vibrating arrangement has two silo tubes which are arranged next to each other transversely with respect to the longitudinal direction, and wherein at least one of the outer closures is in each case common to the two silo tubes.

3. The vibrating arrangement as claimed in claim 1, further comprising:

at least one inner closure arranged in an interior of the at least one silo tube between the at least two outer closures of the at least one silo tube.

4. The vibrating arrangement as claimed in claim 1, wherein at least one inner closure is arranged completely within the at least one silo tube.

5. The vibrating arrangement as claimed in claim 1, further comprising:

at least one inner closure arranged in the at least one silo tube between at least two further outer closures.

6. The vibrating arrangement as claimed in claim 1, wherein the at least one vibrator is designed as a depth vibrator.

7. The vibrating arrangement as claimed in claim 1, wherein the at least one vibrator is designed as a top vibrator.

8. The vibrating arrangement as claimed in claim 1, further comprising:

at least one filling material container arranged movably along the longitudinal direction of the at least one silo tube in front of the at least two outer closures.

9. The vibrating arrangement as claimed in claim 8, further comprising:

at least one guide rail arranged on the at least one silo tube, wherein the at least one filling material container is arranged movably along the at least one guide rail on the at least one silo tube.

10. The vibrating arrangement as claimed in claim 8, wherein the at least one filling material container has at least one opening which faces the casing of the at least one silo tube.

11. The vibrating arrangement as claimed in claim 8, wherein the at least one filling material container is guided on at least one guide rail using rollers.

12. The vibrating arrangement as claimed in claim 8, wherein at least two guide rails are arranged on the at least one silo tube.

13. The vibrating arrangement as claimed in claim 1, wherein at least one of the at least two outer closures has an automatic closing mechanism which permits the at least one outer closure to be opened upon an application of force from the outside and which closes the at least one outer closure again after the application of force ceases.

14. The vibrating arrangement as claimed in claim 13, wherein the automatic closing mechanism has a spring mechanism or a hydraulic mechanism with a bubble store.

15. A vibrating arrangement, comprising:

at least one silo tube for receiving filling material, the at least one silo tube having a longitudinal direction, a longitudinal side filling material outlet at one end of the at least one silo tube, and a casing;

at least one vibrator arranged on the at least one silo tube;

at least one outer closure arranged on the casing of the at least one silo tube or on an end side of the at least one silo tube; and at least one filling material container arranged movably along the longitudinal axis of the at least one silo tube, wherein at least two outer closures are arranged on the casing of the at least one silo tube, and wherein, in the at least one silo tube, at least one inner closure is arranged in the interior of the at least one silo tube between the at least two outer closures.

16. The vibrating arrangement as claimed in claim 15, wherein the at least one filling material container has at least one opening which faces the casing of the at least one silo tube.

17. The vibrating arrangement as claimed in claim 15, further comprising:

at least one guide rail arranged on the at least one silo tube, wherein the at least one filling material container is arranged movably along the at least one guide rail on the at least one silo tube.

18. The vibrating arrangement as claimed in claim 15, wherein the at least one filling material container is guided on at least one guide rail using rollers.

19. The vibrating arrangement as claimed in claim 15, wherein at least two guide rails are arranged on the at least one silo tube.

20. The vibrating arrangement as claimed in claim 15, wherein, in the at least one silo tube, at least one further inner closure is arranged between one of the at least two outer closures and a further outer closure.

21. A vibrating arrangement which comprises:

at least one silo tube for receiving filling material, the at least one silo tube having a longitudinal direction, a longitudinal side filling material outlet at one end of the at least one silo tube, and a casing;

at least one vibrator arranged on the at least one silo tube;

at least one inner closure arranged completely in the interior of the at least one silo tube, wherein the vibrating arrangement includes at least two outer closures, wherein the at least two outer closures are arranged spaced apart from one another along the longitudinal direction.

22. The vibrating arrangement as claimed in claim 21, further comprising:

a tube arrangement with at least two silo tubes which are arranged next to each other transversely with respect to the longitudinal direction, wherein each of the silo tubes has at least one inner closure which is arranged completely within the tube arrangement.

23. A vibrating arrangement, comprising:

a tube arrangement with at least two silo tubes which are arranged next to each other transversely with respect to a longitudinal direction and which each have a filling material outlet; and a vibrator arranged on the tube arrangement in a region of the filling material outlets and which is designed as a depth vibrator, wherein the vibrating arrangement includes at least two outer closures, wherein the at least two outer closures are arranged spaced apart from one another along the longitudinal direction.

* * * * *